US010755651B2

(12) United States Patent
Chen

(10) Patent No.: US 10,755,651 B2
(45) Date of Patent: Aug. 25, 2020

(54) DISPLAY DEVICE AND DRIVING METHOD THEREOF

(71) Applicants: HKC Corporation Limited, Shenzhen (CN); Chongqing HKC Optoelectronics Technology Co., ltd., Chongqing (CN)

(72) Inventor: Yu-Jen Chen, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 226 days.

(21) Appl. No.: 15/848,806

(22) Filed: Dec. 20, 2017

(65) Prior Publication Data

US 2018/0174535 A1 Jun. 21, 2018

Related U.S. Application Data

(63) Continuation of application No. PCT/CN2017/091633, filed on Jul. 4, 2017.

(30) Foreign Application Priority Data

Dec. 20, 2016 (CN) ..... 2016 1 1187510

(51) Int. Cl.

| | |
|---|---|
| ***G09G 3/36*** | (2006.01) |
| ***G09G 3/00*** | (2006.01) |
| ***G09G 3/20*** | (2006.01) |

(52) U.S. Cl.

CPC ..... *G09G 3/3607* (2013.01); *G09G 3/007* (2013.01); *G09G 3/2074* (2013.01); *G09G 3/3611* (2013.01); *G09G 3/3655* (2013.01); *G09G 3/3685* (2013.01); *G09G 3/3696* (2013.01); *G09G 2320/0233* (2013.01); *G09G 2320/0666* (2013.01); *G09G 2320/0673* (2013.01)

(58) Field of Classification Search

CPC ..... G09G 2320/02–029; G09G 2320/06

See application file for complete search history.

(56) References Cited

U.S. PATENT DOCUMENTS

| | | | | |
|---|---|---|---|---|
| 2016/0148583 | A1* | 5/2016 | Nakanishi | G09G 3/3225 345/691 |
| 2016/0260395 | A1* | 9/2016 | Sako | G09G 3/3607 |
| 2016/0300522 | A1* | 10/2016 | Takasaki | G09G 3/342 |

* cited by examiner

*Primary Examiner* — Roy P Rabindranath
(74) *Attorney, Agent, or Firm* — WPAT, PC

(57) ABSTRACT

A driving method of a display panel is provided. A driving method of a display panel including: dividing a plurality of pixels disposed on the display panel into a plurality of pixel groups, each of the pixel groups including even number pixels arranged in matrix; calculating a display hue of each of the pixel groups according to an image input signal; obtaining a gray scale lookup table according to a hue range containing the display hue, a gray scale value of each blue sub-pixel corresponding to two pair of target gray scale values in the gray scale lookup table; obtaining the two pair of the target gray scale values in the gray scale lookup table according to an average gray scale value of blue sub-pixel of each of the pixel groups; obtaining two pair of corresponding driving voltages according to the two pair of the target gray scale values of each of the pixel groups; and driving the blue sub-pixel of the corresponding pixel group according to the two pair of corresponding driving voltages.

14 Claims, 8 Drawing Sheets

DISPLAY DEVICE AND DRIVING METHOD THEREOF

CROSS REFERENCE TO RELATED APPLICATIONS

This application claims priority to and the benefit of Chinese Patent Application No. 201611187510X filed in the State Intellectual Property Office of People's Republic of China on Dec. 20, 2016, the entire contents of which are incorporated herein by reference.

BACKGROUND

Technical Field

The disclosure relates to a display technology and in particular to a display device and a driving method thereof.

Description of the Related Art

Vertical alignment (VA) mode negative liquid crystal display and in-plane switching (IPS) mode liquid crystal display are widely used in conventional large size display device. The brightness of Vertical alignment (VA) mode negative liquid crystal is saturated quickly along with the driving voltage in large viewing angle that result in the color shift of viewing angle is serious, and adversely affects the display quality. As the gray scale increases, the brightness of the side viewing angle of the blue sub-pixel increases. The tendency of brightness saturation is more obvious and quick than the red sub-pixel and the green sub-pixel, so that the image is blueish in color mix viewing angle.

SUMMARY

The present disclosure provides a display device and a driving method thereof, including: dividing a plurality of pixels disposed on the display panel into a plurality of pixel groups, each of the pixel groups including even number pixels arranged in matrix; calculating a display hue of each of the pixel groups according to an image input signal; obtaining a gray scale lookup table according to a hue range containing the display hue, a gray scale value of each blue sub-pixel corresponding to two pair of target gray scale values in the gray scale lookup table, and each pair of target gray scales value including a high gray scale value and a low gray scale value, such that a center view angle brightness of each pair of target gray scale values is the same as a center view angle brightness of a corresponding gray scale value; obtaining the two pair of the target gray scale values in the gray scale lookup table according to an average gray scale value of blue sub-pixel of each of the pixel groups; obtaining two pair of corresponding driving voltages according to the two pair of the target gray scale values of each of the pixel groups; and driving the blue sub-pixel of the corresponding pixel group according to the two pair of corresponding driving voltages.

The present disclosure also provides a display device, including: a display panel, a plurality of pixels disposed on the display panel divided into a plurality of pixel groups, each of the pixel groups including four pixels arranged in matrix; a control element, including a memory unit and at least a process unit, the memory unit storing a calculator executive instructions executed by the process unit, wherein the process unit executing the calculator executive instructions comprises the following steps: calculating a display hue and a color purity of each of the pixel groups according to an image input signal; obtaining a gray scale lookup table according to a hue range containing the display hue and the color purity, a gray scale value of each blue sub-pixel corresponding to two pair of target gray scale values, and each pair of target gray scales value including a high gray scale value and a low gray scale value, such that a center view angle brightness of each pair of target gray scale values is the same as a center view angle brightness of a corresponding gray scale value; obtaining the two pair of the target gray scale values in the gray scale lookup table according to an average gray scale value of blue sub-pixel of each of the pixel groups; obtaining two pair of corresponding driving voltages according to the two pair of the target gray scale values of each of the pixel groups; and a driving element, respectively connecting to the control element and the display panel, the driving element driving the blue sub-pixel of the corresponding pixel group according to the two pair of corresponding driving voltages.

To provide a thorough understanding of the purposes, technical solutions, and advantages of the present invention, the present disclosure will be further described in detail with the accompanying drawings and the embodiments.

BRIEF DESCRIPTION OF THE DRAWINGS

Objects and features of the presently disclosed systems and methods will become apparent to those of ordinary skill in the art when descriptions of various embodiments are read with reference to the accompanying drawings, wherein.

DETAILED DESCRIPTION

In the following detailed description, for purposes of explanation, numerous specific details and embodiments are set forth in order to provide a thorough understanding of the present disclosure. However, the implementation manner of the present disclosure is not limited to the above embodiment. Any variations embodiment of the present disclosure is possible.

Figure 1:
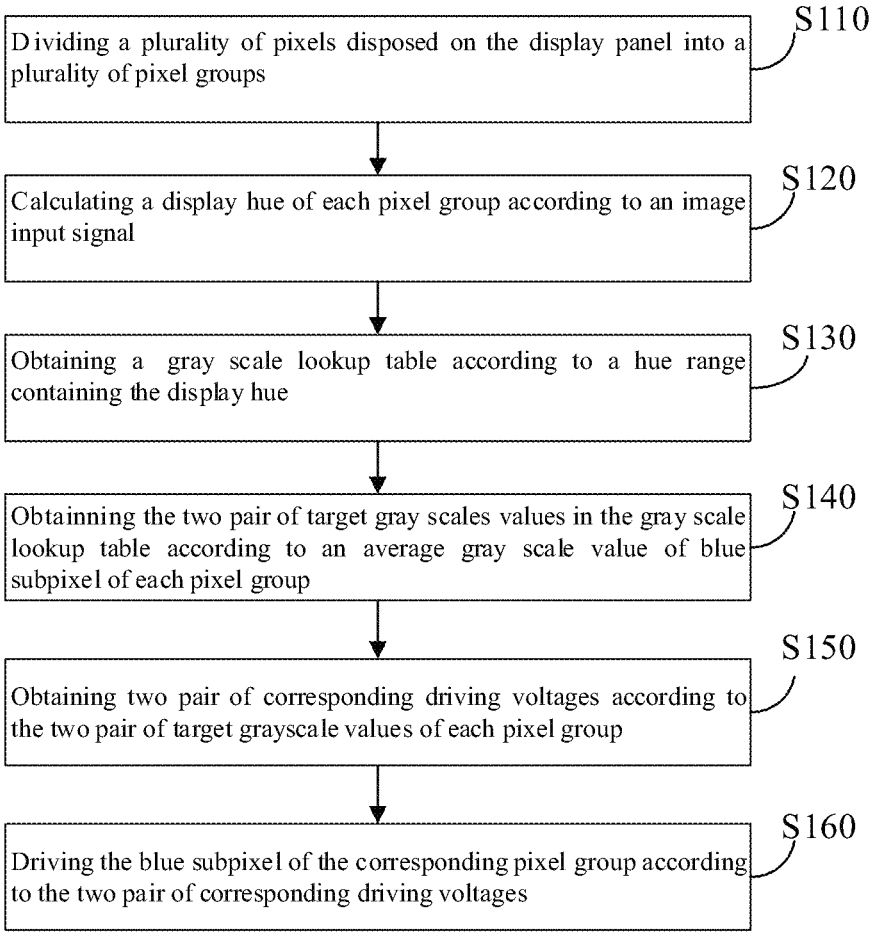
FIG. 1 is a flowchart of a driving method of a display panel in accordance with some embodiments of the present disclosure.

FIG. 1 is a flowchart of a driving method of a display panel. The driving method of the display panel could improve the color shift of the index mismatching of the liquid crystal in large viewing angle. In particular, the driving method of the display panel could improve the color shift of blue sub-pixel quickly saturated in large viewing angle. The display panel may include, but is not limited to, LCD panel, OLED panel, QLED panel and so on, and the display panel may include flat display panel, or curve display panel. When the display panel is LCD panel, it may include, but is not limited to, TN-type, OCB-type, or VA-type display panel.

Referring to FIG. 1, the driving method of the display panel may include the following steps:

Step S110 is dividing a plurality of pixels disposed on the display panel into a plurality of pixel groups.

Figure 2:
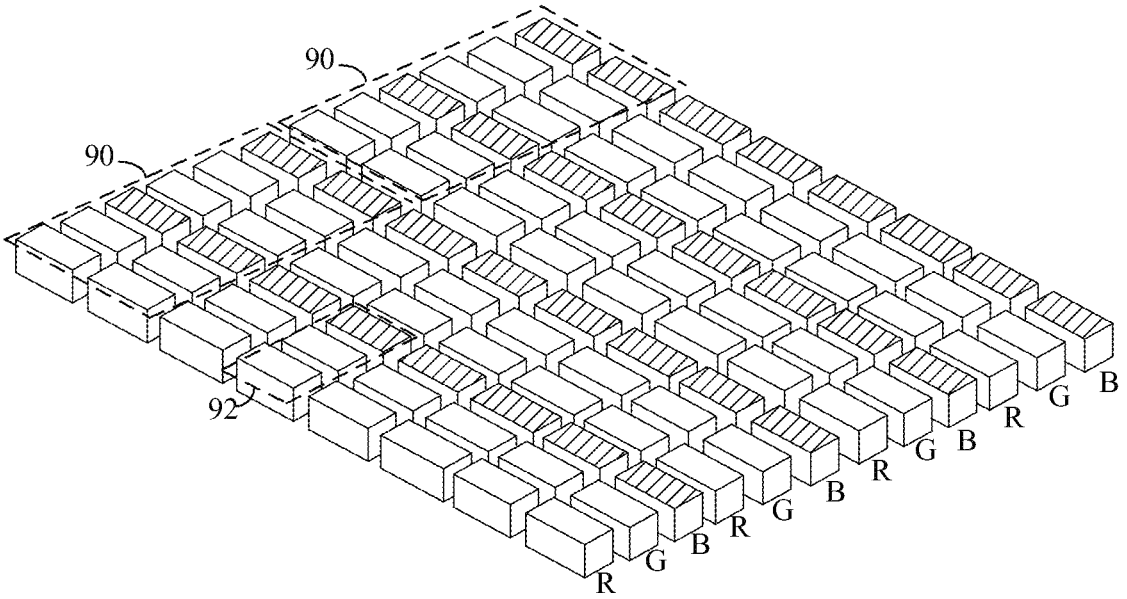
FIG. 2 is a pixel dividing schematic diagram after executing the step S110 in FIG. 1.

After dividing, each of the pixel groups may include even number pixels arranged in matrix. In this embodiment, each of the pixel groups 90 includes four pixels arranged in matrix, as shown in FIG. 2. Each pixel 92 may include a red sub-pixel, a green sub-pixel and a blue sub-pixel, namely, each of the pixel groups 90 includes four blue sub-pixels arranged in matrix. In some embodiments, the number of pixel in each of the pixel groups could be setting according to needs.

Step S120 is calculating a display hue of each of the pixel groups according to an image input signal.

Figure 3:
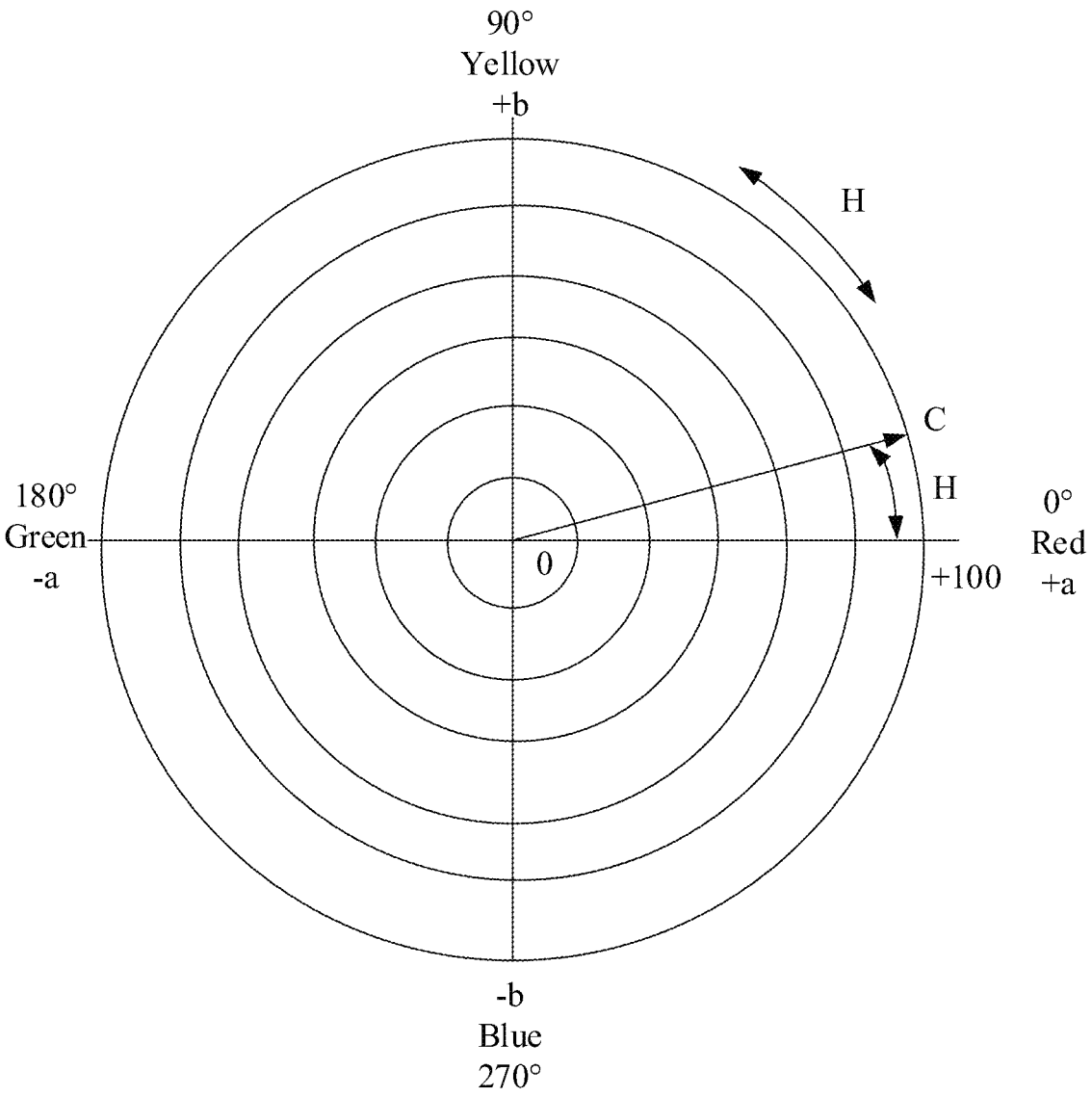
FIG. 3 is a schematic diagram of the CIE LCH color space system in the step S120 in FIG. 1.

The display hue is calculated by a function according to the CIE LCH color space system and referring to the color space coordinates defined by the CIE standard. In particular, L=f1(R, G, B), C=f2(R, G, B), H=f3(R, G, B), wherein L represents the brightness, C represents the color purity which stands for vividness of color, H represents the display hue which stands for color. The relation of the function is understandable according to the CIE standard. the CIE LCH color space system is shown in FIG. 3. There are position indications of only some main colors, such as red, yellow, green and blue, but no other colors in FIG. 3. The CIE LCH color space system is well known in those of ordinary skill in the art, so those of ordinary skill in the art could understand the whole situation of the CIE LCH color space system by provided FIG. 3. In the CIE LCH color space system, 0°-360° are used for representing different color appearances. 0° is defined as red, 90° is defined as yellow, 180° is defined as green, and 270° is defined as blue. The display hue H of each of the pixel groups could be obtained by calculating the average voltage of the pixel group.

Specifically, each pixel includes red sub-pixel, green sub-pixel and blue sub-pixel. Therefore, calculate and obtain the average grayscale R'n, G'n, B'n of each color sub-pixel in each of the pixel groups currently.

$$R'n=\text{Average}(Ri,j+Ri+1,j+Ri,j+1+Ri+1,j+1)$$

$$G'n=\text{Average}(Gi,j+Gi+1,j+Gi,j+1+Gi+1,j+1)$$

$$B'n=\text{Average}(Bi,j+Gi+1,j+Bi,j+1+Bi+1,j+1)$$

Wherein n represents the serial number of the pixel group after dividing, (i, j) represents the order number of red sub-pixel, green sub-pixel and blue sub-pixel in the whole display panel. Therefore, substitute R'n, G'n and B'n into the function: H=f3(R, G, B) to calculate and obtain the display hue H of the corresponding pixel group: H=f3(R'n, G'n, B'n).

In some embodiments, also calculate the color purity C of each of the pixel groups according to the average gray scale. The range of the color purity C is from 0 to 100, 100 represents the color being the most vivid. The value of the color purity C to a certain extent represents the voltage signal of display driving. Substitute R'n, G'n and B'n into the function: C=f2(R, G, B) to calculate and obtain the color purity C of the corresponding pixel group: C=f2(R'n, G'n, B'n).

Step S130 is obtaining a gray scale lookup table according to a hue range containing the display hue.

Before deciding the hue range containing the display hue, the value of the hue is divided into a plurality of range sections. Each range section could be decided according to the degree of the color shift needed to be improved. In this embodiment, the value of the hue is divided into six range sections: the first section: 0°<H≤45° and 315°<H≤360°, the second section: 45°<H≤135°, the third section: 135°<H≤205°, the fourth section: 205°<H≤245°, the fifth section: 245°<H≤295°, and the sixth section: 295°<H≤315°. Therefore, the hue range could be decided according to the display hue of each of the pixel groups. It should be understood, dividing the value of the hue could depend on the needs, not limited to this embodiment.

In this embodiment, the gray scale value of each blue sub-pixel corresponds to two pair of target gray scale values in the gray scale lookup table, and each pair of target gray scales value includes a high gray scale value and a low gray scale value. The high gray scale value and the low gray scale value meet the requirement that a center view angle brightness of the pair of target gray scale values mixed by the high gray scale value and the low gray scale value is the same as a center view angle brightness of the average gray scale value B'n. Preferably, a large view angle brightness of the high gray scale value and the low gray scale value is as close as possible to the center view angle brightness of the average gray scale value B'n. In some embodiments, the difference between the high gray scale value and the low gray scale value of the pair of target gray scale values should be greater than predetermined difference range, such that the two grayscale have a larger difference. The two pair of the target gray scale values have different ranges in the viewing angle color shift improvement, wherein the range in the viewing angle color shift improvement of one pair of target gray scale values is smaller than the range in the viewing angle color shift improvement of another one pair of target gray scale values, one pair of target gray scale values could have better improvement on the color shift in high grayscale value and large viewing angle, and another one pair of target gray scale values could have better improvement on the color shift in low grayscale value and large viewing angle. In this embodiment, the high grayscale value is relative to the low grayscale value of another one pair of target gray scale values. The large viewing angle is defined as greater than 60°, or according to user's definition. The pair of target gray scale values could be obtained by looking up the grayscale value lookup table.

Different hue ranges have different impact on the color shift in viewing angle, so the different hue ranges corresponds to different grayscale value lookup tables, such that the target grayscale value is more suitable to correspond to the driving voltage, and the brightness of the blue sub-pixel in side viewing angle according to the variation of the grayscale is closer to the variation curve in the center viewing angle. A corresponding relation table of each hue range and the grayscale lookup table in advance, so the driving voltage could be decided according to the hue range.

For example, when hue range containing the display hue is the first section, use the grayscale lookup table LUT1 as the following table:

| Input | The first pair of the target gray scale values | | The second pair of the target gray scale values | |
|---|---|---|---|---|
| grayscale | BH1 | BL1 | BH2 | BL2 |
| 0 | 0 | 0 | 0 | 0 |
| 1 | 50 | 0 | 40 | 0 |
| 2 | 80 | 5 | 70 | 10 |
| 3 | 100 | 10 | 100 | 35 |
| 4 | 150 | 20 | 180 | 45 |
| 5 | 180 | 40 | 200 | 65 |
| . | . | . | . | . |
| . | . | . | . | . |
| . | . | . | . | . |
| 255 | 255 | 128 | 255 | 160 |

When hue range containing the display hue is the second section, use the grayscale lookup table LUT2 as the following table:

| Input | The third pair of the target gray scale values | | The fourth pair of the target gray scale values | |
|---|---|---|---|---|
| grayscale | BH1 | BL1 | BH2 | BL2 |
| 0 | 0 | 0 | 0 | 0 |
| 1 | 40 | 0 | 33 | 0 |
| 2 | 75 | 0 | 78 | 10 |
| 3 | 130 | 5 | 90 | 35 |
| 4 | 180 | 15 | 120 | 45 |
| 5 | 200 | 35 | 160 | 65 |
| . | . | . | . | . |
| . | . | . | . | . |
| . | . | . | . | . |
| 255 | 255 | 160 | 255 | 160 |

Dividing the hue range and the relation of each hue range and the grayscale value lookup table are not limited to the above-mentioned embodiment.

In some embodiments, obtaining the grayscale value lookup table is according to the hue range containing both of the display hue and the color purity. Specifically, different hue ranges have different setting of the color purity. Setting the different ranges of the color purity could be decided according to the degree of the color shift needed to be improved. For example, the first section of the hue range corresponds to the first color purity range CTL1≤C≤CTH1, the second section of the hue range corresponds to the second color purity range CTL2≤C≤CTH2, the third section of the hue range corresponds to the third color purity range and so on. Therefore, the hue range containing the display hue and the color purity could be decided according to the display hue and the color purity that obtained by calculating. In this embodiment, the first range containing the display hue H and the color purity C is determined when the display hue H and the color purity C satisfy the following two conditions:

$$0° < H \leq 45° \text{ or } 315° < H \leq 360°$$

$$CTL1 \leq C \leq CTH1$$

The second range containing the display hue H and the color purity C is determined when the display hue H and the color purity C satisfy the following two conditions:

$$45° < H \leq 135°$$

$$CTL2 \leq C \leq CTH2$$

Therefore, the corresponding grayscale value lookup table is obtained according to the hue range containing the display hue and the color purity.

Step S140 is obtaining the two pair of the target gray scale values in the gray scale lookup table according to an average gray scale value of blue sub-pixel of each of the pixel groups.

As mentioned previously, the two pair of the target gray scale values could be obtained by using the corresponding the grayscale value lookup table according to the average gray scale value of blue sub-pixel of each of the pixel groups.

Step S150 is obtaining two pair of corresponding driving voltages according to the two pair of target grayscale values of each of the pixel groups.

The driving voltage and the grayscale value have a corresponding relation, so the two pair of corresponding driving voltages (Bn'_H1 and Bn'_L1, Bn'_H2 and Bn'_L2) could be obtained according to the two pair of target grayscale values. The two pair of corresponding driving voltages could be determined according to the two pair of target grayscale values. In this embodiment, since the driving voltage and the grayscale value have the corresponding relation, the pair of driving voltages has a high driving voltage and a low driving voltage. The driving voltage could be obtained by looking up a driving voltage lookup table. The driving voltage lookup table is a corresponding relation table of the color grayscale value of the input signal of the blue sub-pixel and the driving voltage. In particular, each grayscale value of the blue sub-pixel corresponds to a driving voltage.

Figure 4:
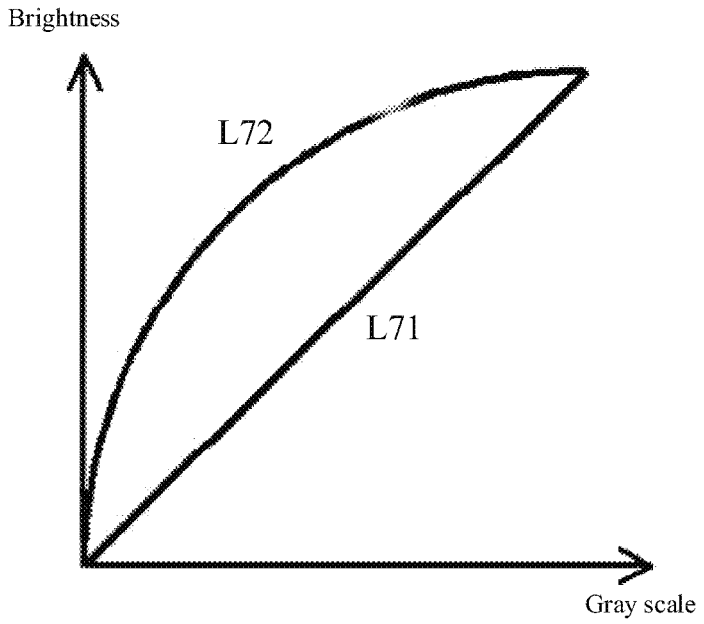
FIG. 4 is a comparison diagram of grayscale/brightness curves in center viewing angle and side viewing angle of driving blue sub-pixel with single driving voltage.
Figure 5:
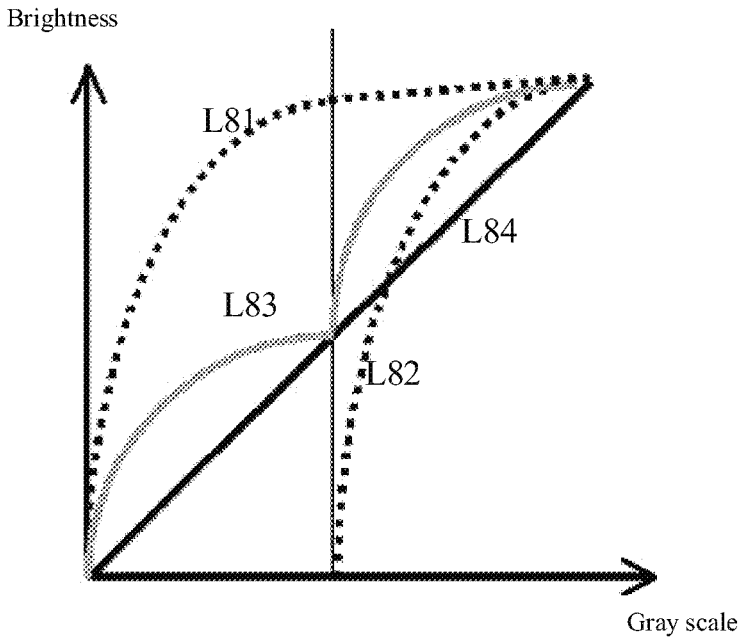
FIG. 5 is a diagram of grayscale/brightness curves in side viewing angle of driving blue sub-pixel respectively with high driving voltage, low driving voltage and high-low driving voltage.

Each pair of high and low driving voltages makes the brightness of the blue sub-pixel in side viewing angle according to the variation of the grayscale is closer to the variation curve in the center viewing angle. The variation of the brightness of the blue sub-pixel in side viewing angle is under control by driving the blue sub-pixel of each of the pixel groups with the high and low driving voltages, so that the saturation tendency of the blue sub-pixel is close to that of the red sub-pixel and the green sub-pixel, or the tendency of the brightness saturation curves of the red sub-pixel, the green sub-pixel and the blue sub-pixel are getting close to reduce the color shift in viewing angle. FIG. 4 is grayscale/brightness curves in center viewing angle and side viewing angle of driving blue sub-pixel with single driving voltage, wherein L71 represents the grayscale/brightness curve in center viewing angle, and L72 represents the grayscale/brightness curve in side viewing angle. Apparently, the grayscale/brightness curve in side viewing angle is easily saturated, such that the image is blueish in color mix viewing angle. FIG. 5 is a diagram of grayscale/brightness curves in side viewing angle of driving blue sub-pixel respectively with high driving voltage, low driving voltage and high-low driving voltage. Wherein L81 represents the grayscale/brightness curve with high voltage driving in side viewing angle, L82 represents the grayscale/brightness curve with low voltage driving in side viewing angle, and L83 is the combination of L81 and L82, namely L83 represents the grayscale/brightness curve with high-low voltage driving in side viewing angle. Obviously, L83 is closer to the grayscale/brightness curve L84 in center viewing angle, so the color shift in viewing angle could be improve by high-low voltage driving.

Since different pair of driving voltages have different viewing angle color shift improvement on different grayscale value range, wherein the two pair of driving voltages have one pair of driving voltages corresponding to the high grayscale value and another one pair of driving voltages corresponding to the low grayscale value. Therefore, each of the pixel groups has one pair of driving voltages having better improvement on the color shift in high grayscale value and large viewing angle, and another one pair of driving voltages having better improvement on the color shift in low grayscale value and large viewing angle, such that the grayscale/brightness variation of the blue sub-pixel could be close the center viewing angle from low grayscale value to high grayscale value after mixing. The color shift caused by the quick saturation of the blue sub-pixel in large viewing angle could be effectively improved.

Step S160 is driving the blue sub-pixel of the corresponding pixel group according to the two pair of corresponding driving voltages.

Figure 6:
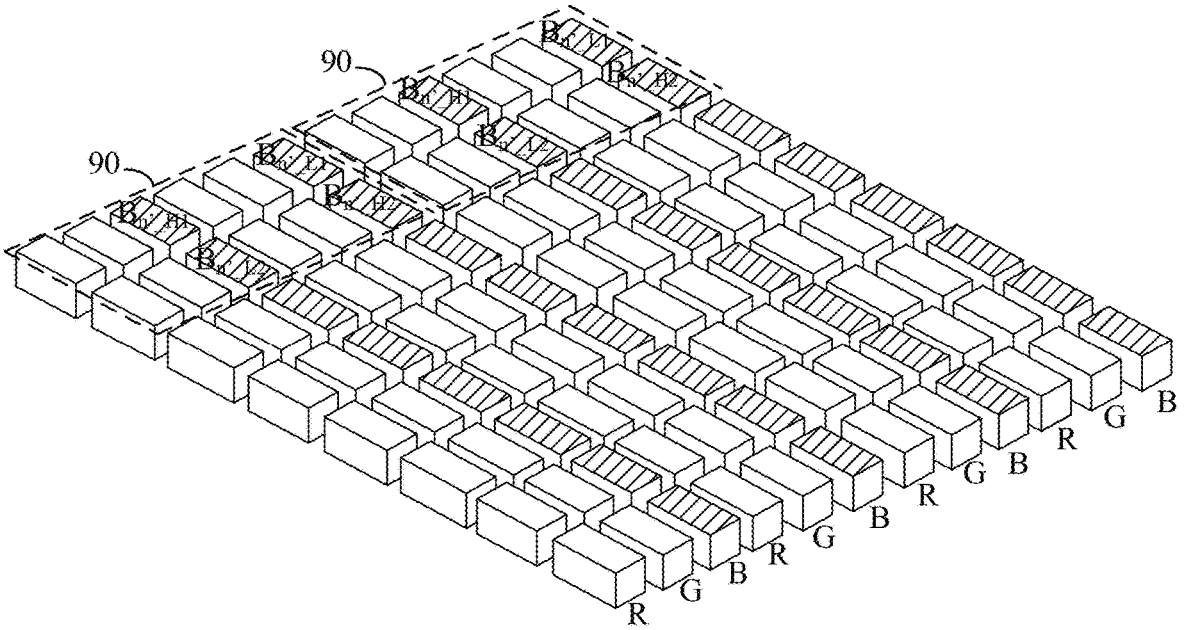
FIG. 6 is a driving schematic diagram after executing the step S150.

Specifically, the two pair of corresponding driving voltages (Bn'_H1 and Bn'_L1, Bn'_H2 and Bn'_L2) respectively drive the blue sub-pixel of the corresponding pixel group, such that the driving voltages of two adjacent blue sub-pixels, one is high driving voltage and another one is low driving voltage. As FIG. 6 shown that improves the color shift in viewing angle by high and low driving voltages.

The driving method of the display panel includes: selecting the corresponding grayscale value lookup table according the display hue of each of the pixel groups on the display panel, and obtaining the two pair of the target gray scale values by using the corresponding the grayscale value lookup table according to the average gray scale value of the blue sub-pixel of each of the pixel groups, such that the target gray scale value match the display hue range. Each pair of the target grayscale values includes a high grayscale value and a low grayscale value, and the center viewing angle brightness of the pair of the target grayscale values is same as the center viewing angle brightness of the average grayscale value, so the brightness is not affected. The two pairs of driving voltages are obtained according to the two pairs of the target grayscale values of each of the pixel groups, such that each of the pixel groups has two pairs of driving voltages which could improve the color shift in viewing angle. Since different pair of driving voltages have different viewing angle color shift improvement on different grayscale value range, such that the grayscale/brightness variation of the blue sub-pixel could be close the center viewing angle from low grayscale value to high grayscale value after mixing. The color shift caused by the quick saturation of the blue sub-pixel in large viewing angle could be effectively improved. After using the driving method, the pixels on the display panel do not have the main and sub pixels, so that the transmittance and the resolution of TFT display panel is increased, and the design cost of the backlight is decreased.

Figure 7:
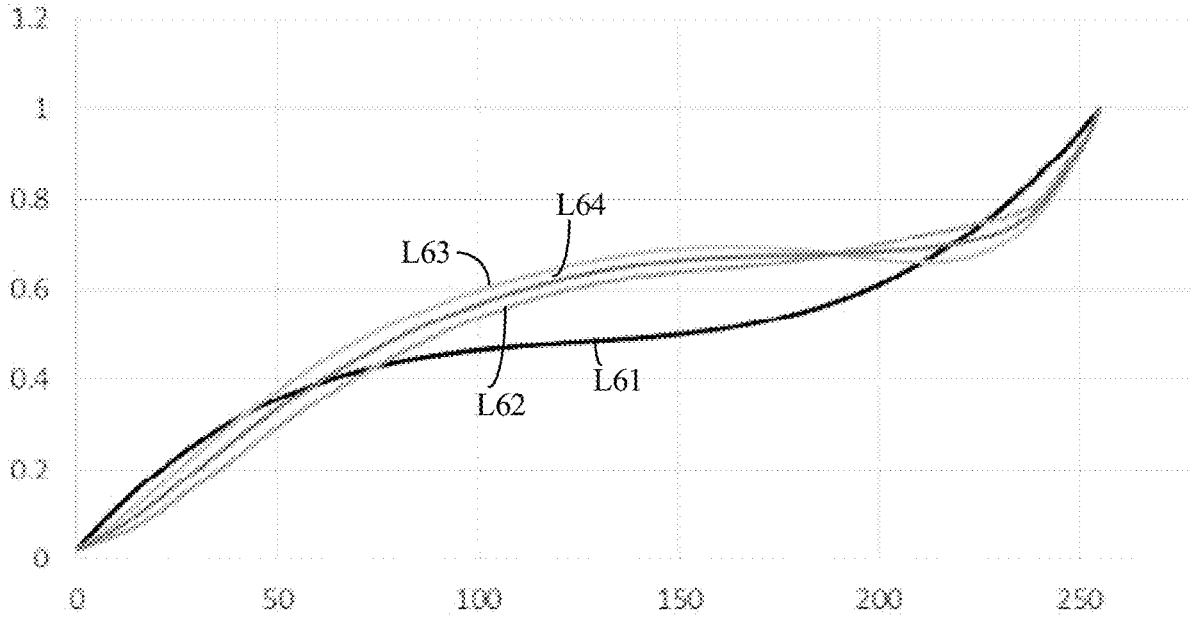
FIG. 7 is a comparison diagram of an ideal grayscale/brightness curve and a grayscale/brightness curve of two voltage combinations.
Figure 8:
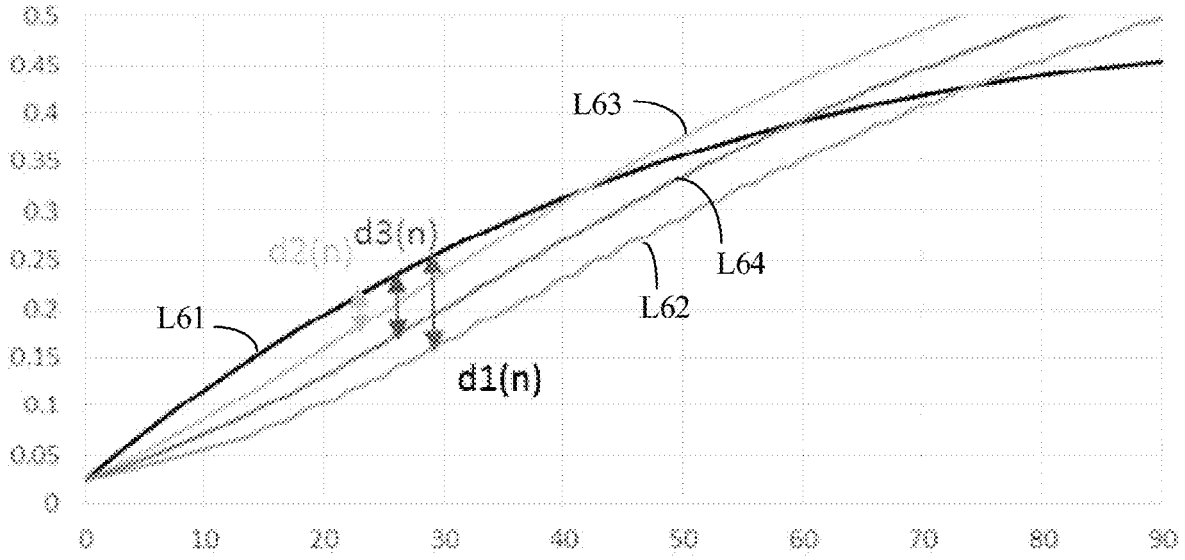
FIGS. 8-9 are diagrams of partial enlargement of FIG. 7.
Figure 9:
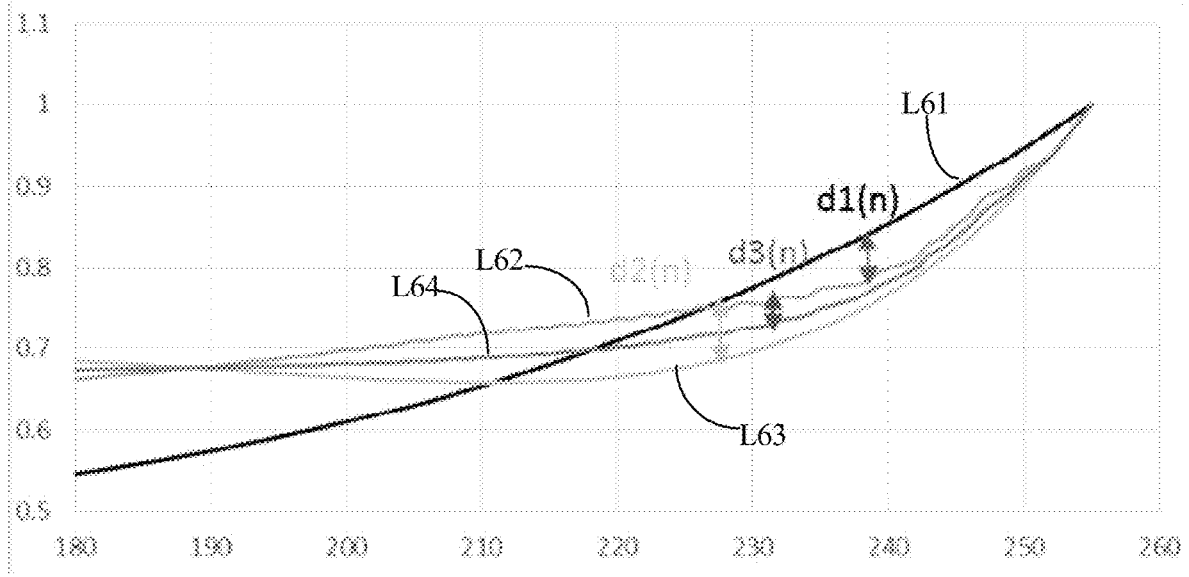

The color shift improvement of the drying method will be further described in detail with FIGS. 7-9 and the embodiments. Referring to FIG. 7, Target gamma is the grayscale/brightness curve of the target blue sub-pixel, corresponding to L61 in FIG. 7. The brightness ratio of RGB in center-viewing angle do not change by space dividing of the blue sub-pixels. Space dividing of the blue sub-pixels has a plurality of combinations of high and low voltages, the saturations of brightness/voltage in side viewing angle of each combination are different. As shown in FIG. 7, the saturations of brightness/voltage in side viewing angle of the combinations gamma1 and gamma2, respectively corresponding to L62 and L63 in FIG. 7. FIGS. 8-9 are diagrams of partial enlargement of FIG. 7. Driving the blue sub-pixel with a pair of high and low voltage, the saturation tendency of grayscale/brightness curve is quicker than the variation tendency of Target gamma, so the color shift in side viewing angle is not solved in FIGS. 7-9. In other words, only one combination of high and low voltages could not satisfy the need of the high and low voltage brightness close to the target brightness.

As shown in FIG. 8, when considering the variation relation of the low voltage (i.e. low grayscale value) and the brightness, the difference d1(n) between the actual brightness of gamma1 and the targer brightness is much greater than the difference d2(n) between the actual brightness of gamma2 and the targer brightness. But as shown in FIG. 9, when considering the variation relation of the high voltage (i.e. high grayscale value) and the brightness, the difference d1(n) between the actual brightness of gamma1 and the targer brightness is much smaller than the difference d2(n) between the actual brightness of gamma2 and the targer brightness. Namely, when the driving voltage of the blue sub-pixel is high (i.e. high grayscale value of the blue sub-pixel) in the image, gamma1 is suitable. When the driving voltage of the blue sub-pixel is low (i.e. low grayscale value of the blue sub-pixel) in the image, gamma2 is suitable. The driving method of this embodiment, each of the pixel groups has a pair of driving voltages for high grayscale value and a pair of driving voltages for low grayscale value, so the curve of the viewing angle brightness of the two pair combinations of driving voltages has the advantage of both, and the curve of the viewing angle brightness is closer to the requirement of the target: the variation of the curve is smooth, and the sudden color change of the image or the abnormal color mixing would not happen. gamma 3 in FIGS. 7-9 (corresponding to L64 in FIGS. 7-9) is the curve of the viewing angle brightness of the combination of gamma land gamma 2. Apparently, the difference d3(n) between the actual brightness of gamma 3 and the targer brightness is always between d1(n) and d2(n), so the variation is closer to the requirement of the target to improve the color shift in viewing angle effectively.

Figure 10:
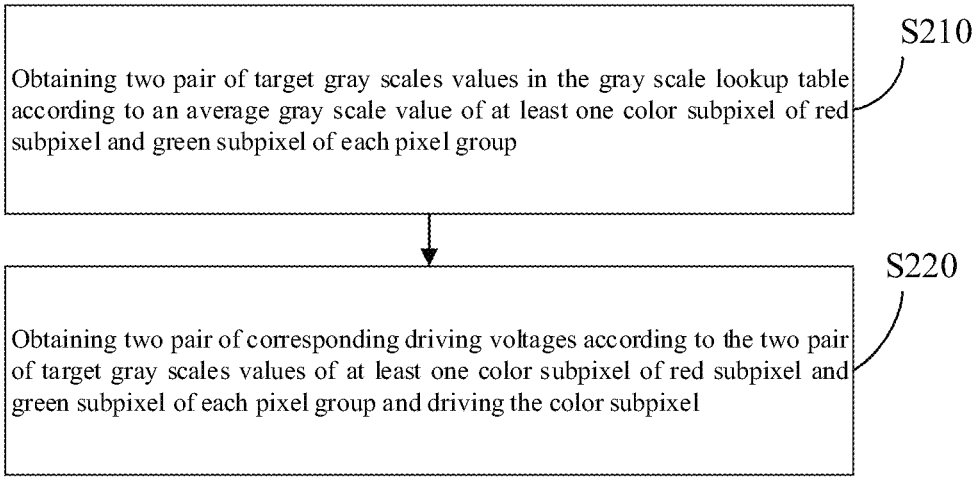
FIG. 10 is a flowchart of a driving method of a display panel in accordance with some embodiments of the present disclosure.

FIG. 10 is a flowchart of a driving method of a display panel of another embodiment. The driving method further includes executing the color shift compensation of at least a color sub-pixel of the red sub-pixel and the green sub-pixel in large viewing angle. The color shift in viewing angle could be improved by sacrificing resolution. In this embodiment, the driving method further includes the following steps on the basis of the above-mentioned embodiments:

Step S210 is obtaining two pair of target gray scales values in the gray scale lookup table according to an average gray scale value of at least one color sub-pixel of red sub-pixel and green sub-pixel of each of the pixel groups.

In this embodiment, the grayscale value of each blue sub-pixel corresponds to two pair of the target grayscale value, the grayscale value of each red sub-pixel corresponds to two pair of the target grayscale value, and the grayscale value of each green sub-pixel corresponds to two pair of the target grayscale value in the grayscale value lookup table. Therefore, the two pair of the target grayscale value could be obtained according to the average grayscale value of the red sub-pixels by using the grayscale value lookup table determined by the method in the embodiment of FIG. 1. Four red sub-pixels of each of the pixel groups is compensated by the two pair of the high and low voltages. The green sub-pixels could not be compensated, or could be compensated by other compensation method, which includes: dividing the green sub-pixels of each of the pixel groups into a pixel unit, obtaining a pair of target gray scales values in the gray scale lookup table according to the average gray scale value of the pixel unit and driving the pixel unit with the corresponding driving voltage. In this way, the display panel could have better color shift improvement and the resolution would not be sacrificed too much.

In some embodiments, the two pair of the target grayscale value also could be obtained according to the average grayscale value of four green sub-pixels in each of the pixel groups, and four green sub-pixels of each of the pixel groups is compensated compensated by the two pair of the high and low voltages. The red sub-pixels could not be compensated, or could be compensated by other compensation method, which includes: dividing the green sub-pixels of each of the pixel groups into a pixel unit, obtaining a pair of target gray scales values in the gray scale lookup table according to the average gray scale value of the pixel unit and driving the pixel unit with the corresponding driving voltage.

In some embodiments, the two pair of the target grayscale value could be obtained according to the average grayscale value of four red sub-pixels in each of the pixel groups and the two pair of the target grayscale value also could be obtained according to the average grayscale value of four green sub-pixels in each of the pixel groups at the same time.

Step S220 is obtaining two pair of corresponding driving voltages according to the two pair of the target gray scale values of at least one color sub-pixel of red sub-pixel and green sub-pixel of each of the pixel groups and driving the color sub-pixel.

The corresponding pixel group could be driven by the corresponding driving voltages according to the two pair of the target gray scale values obtained in Step S210.

The driving method of the display panel compensates the brightness of the blue sub-pixel by high and low driving voltage, also compensates the red sub-pixel and the green sub-pixel. The color shift in large viewing angle could be improved by sacrificing resolution.

Figure 11:
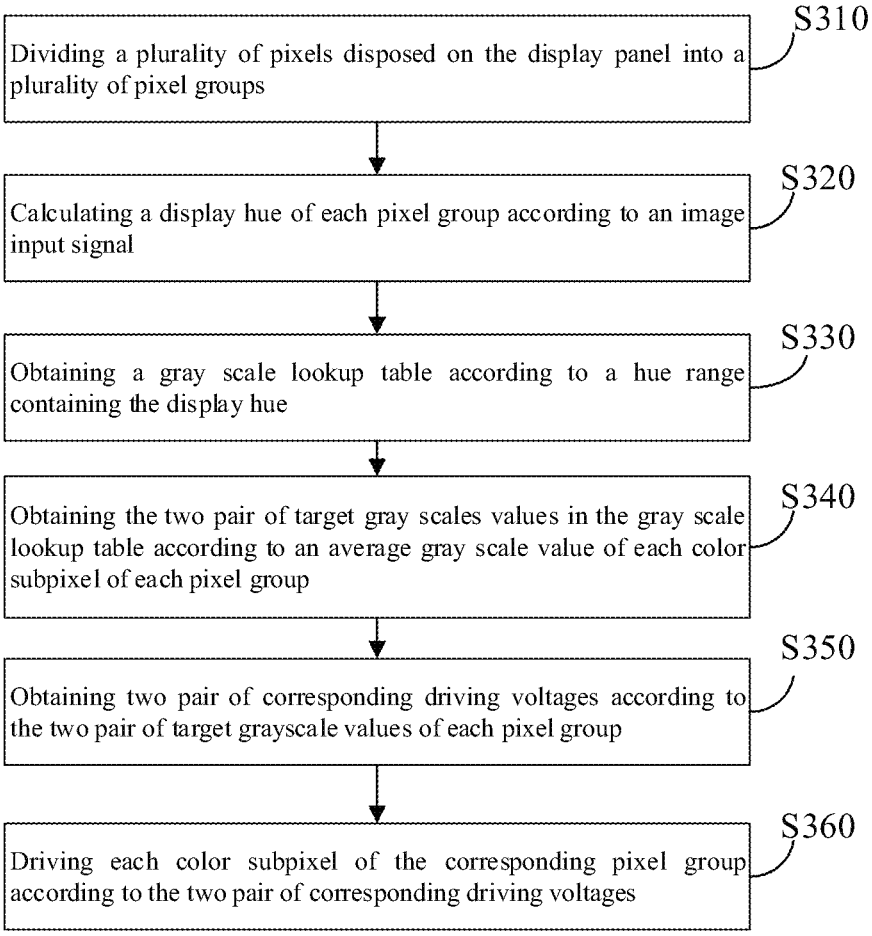
FIG. 11 is a flowchart of a driving method of a display panel in accordance with some embodiments of the present disclosure.

FIG. 11 is a flowchart of a driving method of compensating the red sub-pixels and the green sub-pixels in each of the pixel groups by the same way as compensating the blue sub-pixels. The driving method includes the following steps, and the same steps of implementing have been described in detail in the relevant example method embodiments, which is not illustrated in detail herein.

Step S310 is dividing a plurality of pixels disposed on the display panel into a plurality of pixel groups.

Step S320 is calculating a display hue of each of the pixel groups according to an image input signal.

Step S330 is obtaining a gray scale lookup table according to a hue range containing the display hue.

In this embodiment, the grayscale value of each blue sub-pixel corresponds to two pair of the target grayscale value, the grayscale value of each red sub-pixel corresponds to two pair of the target grayscale value, and the grayscale value of each green sub-pixel corresponds to two pair of the target grayscale value in the grayscale value lookup table.

Step S340 is obtaining the two pair of the target gray scale values in the gray scale lookup table according to an average gray scale value of each color sub-pixel of each of the pixel groups.

In this embodiment, the two pair of the target gray scale values could be obtained by using the corresponding the grayscale value lookup table according to the average gray scale value of red sub-pixel of each of the pixel groups, the two pair of the target gray scale values could be obtained by using the corresponding the grayscale value lookup table according to the average gray scale value of green sub-pixel of each of the pixel groups, and the two pair of the target gray scale values could be obtained by using the corresponding the grayscale value lookup table according to the average gray scale value of blue sub-pixel of each of the pixel groups.

Step S350 is obtaining two pair of corresponding driving voltages according to the two pair of target grayscale values of each of the pixel groups.

the two pair of corresponding driving voltages (Rn'_H1 and Rn'_L1, Rn'_H2 and Rn'_L2), (Gn'_H1 and Gn'_L1, Gn'_H2 and Gn'_L2), (Bn'_H1 and Bn'_L1, Bn'_H2 and Bn'_L2) could be obtained according to the two pair of target grayscale values of each color sub-pixel in each of the pixel groups.

Step S360 is driving each color sub-pixel of the corresponding pixel group according to the two pair of corresponding driving voltages.

The driving method of the display panel compensates the brightness of the blue sub-pixel by high and low driving voltage, also compensates the red sub-pixel and the green sub-pixel. The color shift in large viewing angle could be improved by sacrificing resolution.

Figure 12:
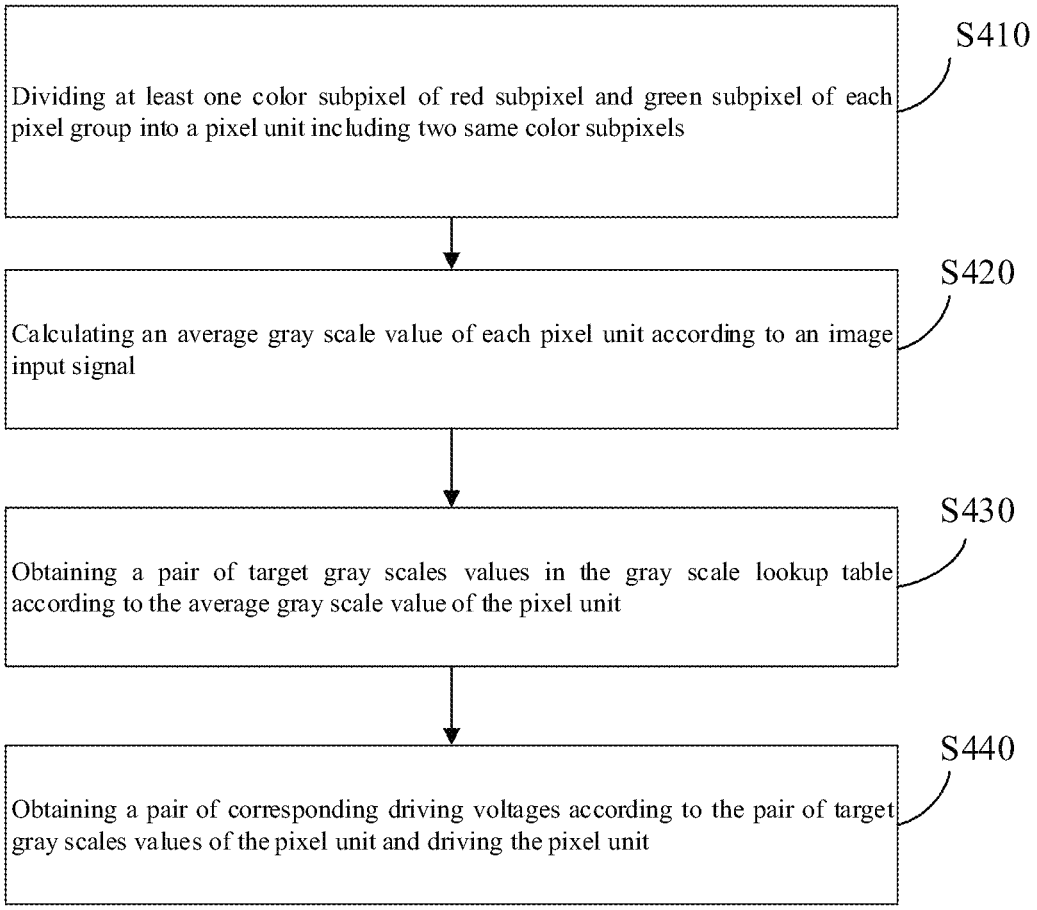
FIG. 12 is a flowchart of a driving method of a display panel in accordance with some embodiments of the present disclosure.

FIG. 12 is a flowchart of a driving method of a display panel of another embodiment. The driving method improves the color shift of the blue sub-pixel by the high and low driving voltage, also executing the color shift compensation of at least a color sub-pixel of the red sub-pixel and the green sub-pixel by the high and low driving voltage. In this embodiment, the driving method further includes the following steps on the basis of the above-mentioned embodiments in FIG. 1:

Step S410 is dividing at least one color sub-pixel of red sub-pixel and green sub-pixel of each of the pixel groups into a pixel unit including two same color sub-pixels.

Since the human eye is more sensitive to red and green, in order to avoid the granular sensation caused by the high and low voltage driving the red sub-pixel and the green sub-pixel same as the blue sub-pixel. In this embodiment, a portion of the red sub-pixels and a portion of the green sub-pixels of each of the pixel groups could be compensated by the high and low driving voltage, namely a portion of the pixel units could be compensated by the high and low driving voltage. In particular, the red sub-pixels of each of the pixel groups could be divided into a pixel unit including two same color sub-pixels. The green sub-pixels of each of the pixel groups could not be compensated, or could be compensated by other compensation method, such as the same way as the blue sub-pixel. In some embodiments, the green sub-pixels of each of the pixel groups could be divided into a pixel unit including two same color sub-pixels. The red sub-pixels of each of the pixel groups could not be compensated, or could be compensated by other compensation method, such as the same way as the blue sub-pixel. In some embodiments, the red sub-pixels of each of the pixel groups could be divided into a pixel unit including two same color sub-pixels, and the green sub-pixels of each of the pixel groups also could be divided into a pixel unit including two same color sub-pixels.

Step S420 is calculating an average gray scale value of each pixel unit according to an image input signal.

The average gray scale value of each pixel unit is the average of the grayscale value of the two red sub-pixels or the average of the grayscale value of the two green sub-pixels in each pixel unit.

Step S430 is obtaining a pair of target gray scales values in the gray scale lookup table according to the average gray scale value of the pixel unit.

The grayscale value lookup table determined by the method in the embodiment of FIG. 1. In this embodiment, a gray scale value of each red sub-pixel corresponds to a pair of target gray scale values in the gray scale lookup table, and a gray scale value of each green sub-pixel corresponds to a pair of target gray scale values in the gray scale lookup table. Therefore, the pair of target gray scale values could be obtained according to the gray scale lookup table.

Step S440 is obtaining a pair of corresponding driving voltages according to the pair of target gray scales values of the pixel unit and driving the pixel unit.

The corresponding pixel unit could be driven by the obtained driving voltages. Since the pixel unit only include two sub-pixels, the pixel unit including red or green sub-pixels could be driven by high and low driving voltages, so the resolution could keep and the color shift could be improved. In this way, the granular sensation caused by the resolution and the serious color shift would not happen.

Figure 13:
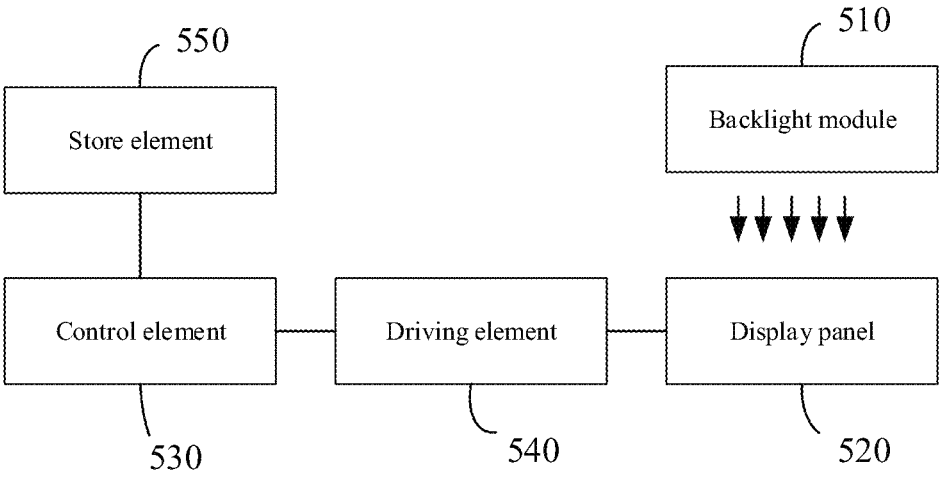
FIG. 13 is a structure block diagram of a display device in accordance with some embodiments of the present disclosure.

The present disclosure also provides a display device, as shown in FIG. 13. The display device could execute the above-mentioned driving method. The display device includes a backlight module 510, a display panel 520, a control element 530 and a driving element 540. The control element 530 and the driving element 540 could be integrated on the display panel 520. It should be understood that the integration of each element is not limited to this embodiment. In some embodiment, the display device could not include the backlight module 510, so a separated backlight module provides the backlight to the display device.

The backlight module 510 is used for providing the backlight. The backlight module 510 may include direct-type backlight or edge-type backlight. The backlight source may include, but is not limited to, white light, RGB light, RGBW light, or RGBY light.

The display panel 520 may include LCD panel, OLED panel, QLED panel and so on, and the display panel 520 may include flat display panel, or curve display panel. It should be understood that the type of the display panel is not limited to this embodiment. When the display panel is LCD panel, it may include, but is not limited to, TN-type, OCB-type, or VA-type TFT display panel. In this embodiment, a plurality of pixels disposed on the display panel 520 divided into a plurality of pixel groups. Each of the pixel groups including even number pixels arranged in matrix. In this embodiment, each of the pixel groups includes four pixels arranged in matrix, also includes four blue sub-pixels arranged in matrix, as shown in FIG. 2.

Figure 14:
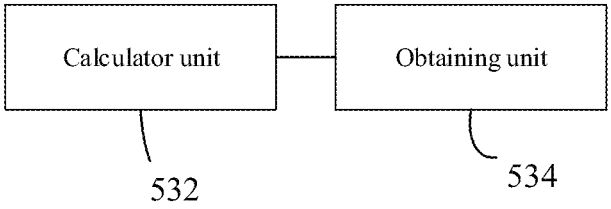
FIG. 14 is a structure block diagram of a control element in accordance with some embodiments of the present disclosure.

The control element 530 includes a calculator unit 532 and an obtaining unit 534, as shown in FIG. 14. The calculator unit 532 is used for calculating a display hue of each of the pixel groups according to an image input signal, and obtaining a gray scale lookup table according to a hue range containing the display hue. The gray scale value of each blue sub-pixel corresponding to two pair of target gray scale values, and each pair of target gray scales value including a high gray scale value and a low gray scale value, such that a center view angle brightness of each pair of target gray scale values is the same as a center view angle brightness of a corresponding gray scale value. The obtaining unit 534 is used for obtaining the two pair of the target gray scale values in the gray scale lookup table according to an average gray scale value of blue sub-pixel of each of the pixel groups, and obtaining two pair of corresponding driving voltages according to the two pair of the target gray scale values of each of the pixel groups. In some embodiments, the calculator unit 532 is used for calculating an average gray scale value of each color sub-pixel of each of the pixel groups according to the image input signal, and calculating the display hue of each of the pixel groups according to the average gray scale value of each color sub-pixel of each of the pixel groups. The calculator unit 532 is used for calculating a color purity of each of the pixel groups according to the image input signal. The obtaining unit 534 is used for obtaining the gray scale lookup table according to the hue range containing the display hue is according to the hue range containing the display hue and the color purity of each of the pixel groups, and obtaining two pair of corresponding driving voltages according to the two pair of the target gray scale values of each of the pixel groups. In this embodiment, the display device may further include a store element 550 used for storing the gray scale lookup table.

The driving element 540 respectively connects to the control element 530 and the display panel 520, and the driving element 540 drives the blue sub-pixel of the corresponding pixel group according to the two pair of corresponding driving voltages, such that the driving voltages of two adjacent blue sub-pixels, one is high driving voltage and another one is low driving voltage.

The display device selects the corresponding grayscale value lookup table according the display hue of each of the pixel groups on the display panel 510, and obtains the two pair of the target gray scale values by using the corresponding the grayscale value lookup table according to the average gray scale value of the blue sub-pixel of each of the pixel groups, such that the target gray scale value match the display hue range. Each pair of the target grayscale values includes a high grayscale value and a low grayscale value, and the center viewing angle brightness of the pair of the target grayscale values is same as the center viewing angle brightness of the average grayscale value, so the brightness is not affected. The two pairs of driving voltages are obtained according to the two pairs of the target grayscale values of each of the pixel groups, such that each of the pixel groups has two pairs of driving voltages which could improve the color shift in viewing angle. Since different pair of driving voltages have different viewing angle color shift improvement on different grayscale value range, such that the grayscale/brightness variation of the blue sub-pixel could be close the center viewing angle from low grayscale value to high grayscale value after mixing. The color shift caused by the quick saturation of the blue sub-pixel in large viewing angle could be effectively improved. After using the driving method, the pixels on the display panel do not have the main and sub pixels, so that the transmittance and the resolution of TFT display panel is increased, and the design cost of the backlight is decreased.

In some embodiments, on the basis of the above-mentioned embodiments, the display device executes the color shift compensation of at least a color sub-pixel of the red sub-pixel and the green sub-pixel in large viewing angle. The color shift in viewing angle could be improved by sacrificing resolution. In this embodiment, a gray scale value of each red sub-pixel is corresponding to two pair of target gray scale values in the gray scale lookup table, a gray scale value of each green sub-pixel is corresponding to two pair of target gray scale values in the gray scale lookup table. The obtaining unit 534 is used for obtaining two pair of target gray scales values in the gray scale lookup table according to an average gray scale value of at least one color sub-pixel of red sub-pixel and green sub-pixel of each of the pixel groups, and obtaining two pair of corresponding driving voltages according to the two pair of the target gray scale values of at least one color sub-pixel of red sub-pixel and green sub-pixel of each of the pixel groups. The driving element is used for driving the color sub-pixel with the corresponding driving voltages.

The display device executes the high and low driving voltages compensation of the brightness of the blue sub-pixel. Meanwhile, the display device also executes the high and low driving voltages compensation of the red sub-pixel and the green sub-pixel. The color shift in viewing angle could be improved by sacrificing resolution.

In some embodiments, the display device executes the high and low driving voltages compensation of the brightness of the blue sub-pixel. Meanwhile, the display device also executes the high and low driving voltages compensation of at least a color sub-pixel of the red sub-pixel and the green sub-pixel. Specifically, at least one color sub-pixel of red sub-pixel and green sub-pixel of each of the pixel groups on the display panel 510 are divided into a pixel unit including two same color sub-pixels. The calculator unit 532 is used for calculating an average gray scale value of each pixel unit according to an input image signal. In this embodiment, a gray scale value of each red sub-pixel is corresponding to two pair of target gray scale values in the gray scale lookup table, a gray scale value of each green sub-pixel is corresponding to two pair of target gray scale values in the gray scale lookup table. Therefore, the obtaining unit 534 is used for obtaining the corresponding driving voltages according to the target gray scales values of at least one color sub-pixel of red sub-pixel and green sub-pixel of each of the pixel groups. The driving element is used for driving the color sub-pixel with the corresponding driving voltages.

In the display device, since the pixel unit only include two sub-pixels, the pixel unit including red or green sub-pixels could be driven by high and low driving voltages, so the resolution could keep and the color shift could be improved. In this way, the granular sensation caused by the resolution and the serious color shift would not happen.

In some embodiments, a display device includes: a display panel, a plurality of pixels disposed on the display panel divided into a plurality of pixel groups, each of the pixel groups including four pixels arranged in matrix; a control element, including a memory unit and at least a process unit, the memory unit storing a calculator executive instructions executed by the process unit, wherein the process unit executing the calculator executive instructions comprises the following steps: calculating a display hue and a color purity of each of the pixel groups according to an image input signal; obtaining a gray scale lookup table according to a hue range containing the display hue and the color purity, a gray scale value of each blue sub-pixel corresponding to two pair of target gray scale values, and each pair of target gray scales value including a high gray scale value and a low gray scale value, such that a center view angle brightness of each pair of target gray scale values is the same as a center view angle brightness of a corresponding gray scale value; obtaining the two pair of the target gray scale values in the gray scale lookup table according to an average gray scale value of blue sub-pixel of each of the pixel groups; obtaining two pair of corresponding driving voltages according to the two pair of the target gray scale values of each of the pixel groups; and a driving element, respectively connecting to the control element and the display panel, the driving element driving the blue sub-pixel of the corresponding pixel group according to the two pair of corresponding driving voltages.

In this embodiment, each of the pixel groups includes four pixels arranged in matrix.

In some embodiments, the process unit executing the calculator executive instructions further includes the following steps: calculating an average gray scale value of each color sub-pixel of each of the pixel groups according to the image input signal, and calculating the display hue of each of the pixel groups according to the average gray scale value of each color sub-pixel of each of the pixel groups.

In some embodiments, the process unit executing the calculator executive instructions further includes the following steps: calculating a color purity of each of the pixel groups according to the image input signal, and obtaining a gray scale lookup table according to a hue range containing the containing the display hue and the color purity of each of the pixel groups.

In some embodiments, the display device further includes a store element, the storing element is used for storing a corresponding relation table of each hue range and the gray scale lookup table.

In some embodiments, a gray scale value of each red sub-pixel is corresponding to two pair of target gray scale values in the gray scale lookup table, a gray scale value of each green sub-pixel is corresponding to two pair of target gray scale values in the gray scale lookup table, and the process unit executing the calculator executive instructions further includes the following steps: obtaining two pair of target gray scales values in the gray scale lookup table according to an average gray scale value of at least one color sub-pixel of red sub-pixel and green sub-pixel of each of the pixel groups; and obtaining two pair of corresponding driving voltages according to the two pair of the target gray scale values of at least one color sub-pixel of red sub-pixel and green sub-pixel of each of the pixel groups, and the driving element driving the color sub-pixel according to the corresponding driving voltages.

In some embodiments, at least one color sub-pixel of red sub-pixel and green sub-pixel of each of the pixel groups are divided into a pixel unit including two same color sub-pixels, and the process unit executing the calculator executive instructions further includes the following steps: calculating an average gray scale value of each pixel unit; obtaining a pair of target gray scales values in the gray scale lookup table according to the average gray scale value of the pixel unit, a gray scale value of each red sub-pixel corresponding to a pair of target gray scale values in the gray scale lookup table, and a gray scale value of each green sub-pixel corresponding to a pair of target gray scale values in the gray scale lookup table; and obtaining a pair of corresponding driving voltages according to the pair of target gray scales values of the pixel unit, and the driving element driving the pixel unit according to the corresponding driving voltages.

In some embodiments, the driving element drives the blue sub-pixel of the corresponding pixel group according to the two pair of corresponding driving voltages, the driving voltages of two adjacent blue sub-pixels are different.

In some embodiments, the display panel comprises a flat display panel or a curve display panel.

In some embodiments, a display device includes: a display panel, a plurality of pixels disposed on the display panel divided into a plurality of pixel groups, each of the pixel groups including four pixels arranged in matrix; a control element, including a memory unit and at least a process unit, the memory unit storing a calculator executive instructions executed by the process unit, wherein the process unit executing the calculator executive instructions comprises the following steps: calculating a display hue and a color purity of each of the pixel groups according to an image input signal; obtaining a gray scale lookup table according to a hue range containing the display hue and the color purity, a gray scale value of each blue sub-pixel corresponding to two pair of target gray scale values, and each pair of target gray scales value including a high gray scale value and a low gray scale value, such that a center view angle brightness of each pair of target gray scale values is the same as a center view angle brightness of a corresponding gray scale value; obtaining the two pair of the target gray scale values in the gray scale lookup table according to an average gray scale value of blue sub-pixel of each of the pixel groups; obtaining two pair of corresponding driving voltages according to the two pair of the target gray scale values of each of the pixel groups; and a driving element, respectively connecting to the control element and the display panel, the driving element driving the blue sub-pixel of the corresponding pixel group according to the two pair of corresponding driving voltages.

Although some embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A driving method of a display panel, comprising:

dividing a plurality of pixels disposed on the display panel into a plurality of pixel groups, each of the pixel groups including an even number of pixels arranged in a matrix;

calculating a display hue of each of the pixel groups according to an image input signal;

obtaining a gray scale lookup table according to a hue range containing the display hue, a gray scale value of each of blue sub-pixels of the pixels of each of the pixel groups corresponding to two pairs of target gray scale values in the gray scale lookup table, and each pair of the target gray scale values including a high gray scale value and a low gray scale value, such that a center view angle brightness of each pair of the target gray scale values is the same as a center view angle brightness of a corresponding gray scale value;

obtaining the two pairs of the target gray scales values in the gray scale lookup table according to an average gray scale value of the blue sub-pixels of each of the pixel groups;

obtaining two pairs of corresponding driving voltages according to the two pairs of the target gray scales values of each of the pixel groups; and driving the blue sub-pixels of the corresponding pixel group according to the two pairs of corresponding driving voltages.

2. The driving method of a display panel of claim 1, wherein each of the pixel groups includes four pixels arranged in a matrix.

3. The driving method of a display panel of claim 1, wherein the step of calculating a display hue of each of the pixel groups according to an image input signal includes:

calculating an average gray scale value of each color sub-pixel of each of the pixel groups according to the image input signal; and calculating the display hue of each of the pixel groups according to the average gray scale value of each color sub-pixel of each of the pixel groups.

4. The driving method of a display panel of claim 1, wherein the step of calculating a display hue of each of the pixel groups according to an image input signal further includes calculating a color purity of each of the pixel groups according to the image input signal, and wherein the step of obtaining a gray scale lookup table according to a hue range containing the display hue is according to the hue range containing the display hue and the color purity of each of the pixel groups.

5. The driving method of a display panel of claim 1, wherein the driving method of the display panel further comprises storing a corresponding relation table of each hue range and the gray scale lookup table in advance.

6. The driving method of a display panel of claim 1, wherein in the step of driving the blue sub-pixels of the corresponding pixel group according to the two pairs of corresponding driving voltages, the driving voltages of two adjacent of the blue sub-pixels are different.

7. A display device, comprising:

a display panel, a plurality of pixels disposed on a display panel divided into a plurality of pixel groups, each of the pixel groups including an even number of pixels arranged in a matrix;

a control element, including a memory unit and at least a process unit, the memory unit storing calculator executive instructions executed by the process unit, wherein the process unit executing the calculator executive instructions comprises the following steps:

calculating a display hue of each of the pixel groups according to an image input signal;

obtaining a gray scale lookup table according to a hue range containing the display hue, a gray scale value of each of blue sub-pixels of the pixels of each of the pixel groups corresponding to two pairs of target gray scale values, and each pair of target gray scales value including a high gray scale value and a low gray scale value, such that a center view angle brightness of each pair of target gray scale values is the same as a center view angle brightness of a corresponding gray scale value;

obtaining the two pairs of the target gray scale values in the gray scale lookup table according to an average gray scale value of blue sub-pixels of each of the pixel groups;

obtaining two pairs of corresponding driving voltages according to the two pairs of the target gray scale values of each of the pixel groups; and a driving element, respectively connecting to the control element and the display panel, the driving element driving the blue sub-pixels of the corresponding pixel group according to the two pairs of corresponding driving voltages.

8. The display device of claim 7, wherein each of the pixel groups includes four pixels arranged in a matrix.

9. The display device of claim 7, wherein the process unit executing the calculator executive instructions further comprises the following steps:

calculating an average gray scale value of each color sub-pixel of each of the pixel groups according to the image input signal; and calculating the display hue of each of the pixel groups according to the average gray scale value of each color sub-pixel of each of the pixel groups.

10. The display device of claim 7, wherein the process unit executing the calculator executive instructions further comprises the following steps:

calculating a color purity of each of the pixel groups according to the image input signal; and obtaining a gray scale lookup table according to a hue range containing the containing the display hue and the color purity of each of the pixel groups.

11. The display device of claim 7, wherein the display device further comprises a storing element, the storing element is used for storing a corresponding relation table of each hue range and the gray scale lookup table.

12. The display device of claim 7, wherein the driving element drives the blue sub-pixels of the corresponding pixel group according to the two pairs of corresponding driving voltages, the driving voltages of two adjacent of the blue sub-pixels are different.

13. The display device of claim 7, wherein the display panel comprises a flat display panel or a curve display panel.

14. A display device, comprising:

a display panel, a plurality of pixels disposed on the display panel divided into a plurality of pixel groups, each of the pixel groups including four pixels arranged in a matrix;

a control element, including a memory unit and at least a process unit, the memory unit storing calculator executive instructions executed by the process unit, wherein the process unit executing the calculator executive instructions comprises the following steps:

calculating a display hue and a color purity of each of the pixel groups according to an image input signal;

obtaining a gray scale lookup table according to a hue range containing the display hue and the color purity, a gray scale value of each of blue sub-pixels of the four pixels of each of the pixel groups corresponding to two pairs of target gray scale values, and each pair of target gray scales value including a high gray scale value and a low gray scale value, such that a center view angle brightness of each pair of target gray scale values is the same as a center view angle brightness of a corresponding gray scale value;

obtaining the two pairs of the target gray scale values in the gray scale lookup table according to an average gray scale value of blue sub-pixels of each of the pixel groups;

obtaining two pairs of corresponding driving voltages according to the two pairs of the target gray scale values of each of the pixel groups; and a driving element, respectively connecting to the control element and the display panel, the driving element driving the blue sub-pixels of the corresponding pixel group according to the two pairs of corresponding driving voltages.

* * * * *